US006082558A

United States Patent [19]

Battaglia

[11] Patent Number: 6,082,558

[45] **Date of Patent: *Jul. 4, 2000**

[54] SHELF ASSEMBLY WITH PUSHER HAVING MEMORY CHARACTERISTIC AND METHOD OF USE

[75] Inventor: Joseph M. Battaglia, Douglasville, Ga.

[73] Assignee: L&P Property Management Company, South Gate, Calif.

[ * ] Notice: This patent is subject to a terminal disclaimer.

[21] Appl. No.: 09/090,446

[22] Filed: Jun. 4, 1998

Related U.S. Application Data

[63] Continuation-in-part of application No. 09/046,326, Mar. 23, 1998, Pat. No. 5,988,407, which is a continuation-in-part of application No. 08/919,891, Aug. 28, 1997, Pat. No. 6,015,051.

[51] Int. Cl.[7] ..... A47F 1/04; A47F 1/12

[52] U.S. Cl. ..... 211/59.3; 211/51; 312/71

[58] Field of Search ..... 211/51, 52, 54.1, 211/59.3; 312/71

[56] References Cited

U.S. PATENT DOCUMENTS

| | | | |
|---|---|---|---|
| D. 277,915 | 3/1985 | Field . | |
| 1,229,948 | 6/1917 | Hall . | |
| 1,682,580 | 8/1928 | Pratt . | |
| 1,728,694 | 9/1929 | Morris . | |
| 1,893,098 | 1/1933 | Murray, Sr. et al. . | |
| 1,959,614 | 5/1934 | Coons . | |
| 2,095,649 | 10/1937 | Oswell . | |
| 2,124,780 | 6/1938 | Keppler et al. . | |
| 2,222,887 | 11/1940 | Willey . | |
| 2,331,035 | 10/1943 | Lundstrom . | |
| 2,435,104 | 1/1948 | Solomon . | |
| 2,538,165 | 1/1951 | Randtke . | |
| 2,564,518 | 8/1951 | Bedinger . | |
| 2,656,233 | 10/1953 | Bollmann . | |
| 2,732,952 | 1/1956 | Skelton . | |
| 2,855,632 | 10/1958 | Croce et al. . | |
| 2,927,699 | 3/1960 | McGraw . | |
| 2,954,129 | 9/1960 | Gordon . | |
| 3,039,221 | 6/1962 | Musgrave . | |
| 3,110,402 | 11/1963 | Mogulescu . | |
| 3,212,667 | 10/1965 | Kleist et al. | 211/51 X |
| 3,265,404 | 8/1966 | Skufca . | |
| 3,357,597 | 12/1967 | Groff . | |
| 3,393,948 | 7/1968 | Brefka . | |
| 3,583,724 | 6/1971 | Cowlin . | |
| 3,589,523 | 6/1971 | Belden | 211/51 |
| 3,612,288 | 10/1971 | Lesley . | |
| 3,679,096 | 7/1972 | Musser . | |
| 4,234,101 | 11/1980 | Pastore . | |
| 4,314,648 | 2/1982 | Spamer . | |
| 4,588,093 | 5/1986 | Field . | |
| 4,589,349 | 5/1986 | Gebhardt et al. . | |
| 4,602,570 | 7/1986 | Lee . | |
| 4,646,658 | 3/1987 | Lee . | |
| 4,660,477 | 4/1987 | Kortering et al. . | |
| 4,730,741 | 3/1988 | Jackle, III et al. . | |
| 4,762,236 | 8/1988 | Jackle, III et al. . | |
| 4,776,472 | 10/1988 | Rosen . | |
| 4,822,555 | 4/1989 | Kawabata . | |
| 4,836,390 | 6/1989 | Polvere | 211/51 X |
| 4,838,436 | 6/1989 | Bailey . | |
| 4,919,403 | 4/1990 | Bartholomew . | |
| 4,923,070 | 5/1990 | Jackle et al. . | |
| 5,012,936 | 5/1991 | Crum | 211/51 X |
| 5,161,702 | 11/1992 | Skalski | 211/51 X |
| 5,240,125 | 8/1993 | Kunz . | |

(List continued on next page.)

*Primary Examiner*—Daniel P. Stodola
*Assistant Examiner*—Gregory J. Strimbu
*Attorney, Agent, or Firm*—Wood, Herron & Evans, L.L.P.

[57] ABSTRACT

A shelf assembly for merchandising a plurality of products comprising a shelf and a plurality of pushers engaged with the shelf for urging the products forwardly. Each pusher is made of a flexible material having a memory characteristic which biases the pusher into a generally planar orientation from an inverted U-shaped configuration between the products and a rear edge of the shelf. The pushers may be individually formed or an integral part of a single sheet of material. The pushers may have tabs which slidably engage slots in the shelf.

33 Claims, 4 Drawing Sheets

U.S. PATENT DOCUMENTS 5,419,443 5/1995 Niederberger et al. .
5,449,076 9/1995 Van Noord .
5,450,968 9/1995 Bustos .
5,450,969 9/1995 Johnson et al. ..... 211/51
5,562,217 10/1996 Salveson et al. ..... 211/51 X
5,577,623 11/1996 Bustos .
5,614,288 3/1997 Bustos .
5,641,077 6/1997 Tufano et al. ..... 211/54.1
5,665,304 9/1997 Heinen et al. .

SHELF ASSEMBLY WITH PUSHER HAVING MEMORY CHARACTERISTIC AND METHOD OF USE

RELATIONSHIP TO OTHER APPLICATIONS

This patent application is a continuation-in-part application of U.S. patent application Ser. No. 09/046,326, filed Mar. 23, 1998, now U.S. Pat. No. 5,988,407, which is hereby fully incorporated by reference. U.S. patent application Ser. No. 09/046,326 is a continuation-in-part application of U.S. patent application Ser. No. 08/919,891, filed Aug. 28, 1997, now U.S. Pat. No. 6,015,051, which is fully incorporated by reference as well.

FIELD OF THE INVENTION

This invention relates to a self-feeding shelf assembly in which a plurality of pushers push columns of product arranged on a shelf of the assembly forwardly to locate product at the front of the shelf.

BACKGROUND OF THE INVENTION

Merchants commonly display their products in shelved structures. Often such shelved structures have a plurality of shelves, each shelf having a plurality of dividers dividing the shelf into a plurality of tracks extending from the back of the shelf forwardly. Product being displayed is arranged in columns on the shelf, the columns being located within the tracks. These tracks enable the merchant to separate items for purposes of maximizing the number of objects or items being displayed or to enable different items in different tracks to be displayed in order to enable a consumer to easily differentiate between products. Typically, a consumer grabs the forwardmost product in a column. If the shelf is horizontally oriented, the products behind the forwardmost product in a track may remain in essentially the same position once the forwardmost product has been removed such that a second consumer must reach further back in the display to grasp the closest available product within the track. As more products are removed from the track, customers must reach further back inside the track to grasp a product.

In order to provide a continuous supply of product at the front of the tracks of shelves of a display rack shelf, shelves have been declined such that the front of the shelves are located below the rear of the shelves. Gravity then forces the product to the forward edge of such shelves where it is easily accessible to customers. The angle of the shelf determines the amount of force gravity will have on the product so that the product moves forward. Often plastic slip surfaces, such as that disclosed in U.S. Pat. No. 5,614,288, are placed on such shelves providing a slip surface enabling the products to more easily slide forwardly to the front of the declined shelf. The plastic used to make such slip surfaces may be impregnated with silicone in order to increase the slipperiness of the plastic so that products may more easily slide down the slip surface to the front of the shelf. Even without a declined shelf, a plastic slip surface may aid in the delivery of products to the front of the shelf.

Several patents have disclosed devices which have attempted to move product forwardly on a horizontal shelf. U.S. Pat. No. 2,732,952 discloses a shelf attachment which comprises two plates hinged together at the top of the plates. A spring urges the two plates apart from one another such that when the shelf attachment is placed between a vertical wall and product on a horizontal shelf, the spring causes the plates to separate urging the product forwardly on the shelf. The rear plate is attached to the vertical wall with screws and the forwardmost plate has a strip upon which the rearwardmost products on the shelf rest. Although this patent does disclose a device for urging products forwardly on a horizontal shelf, the springs used in the device are subject to wear and tear and may deteriorate over time causing the device to not function properly. Further, such a device must be secured to a vertical wall at the back of the shelf with screws and without such a vertical wall, the device will not function correctly.

Similarly, U.S. Pat. No. 5,450,969 discloses a device for use on a horizontal shelf for urging products forwardly on the shelf. The shelf is divided into tracks by dividers and a backing plate urges a row of products forwardly within each track. Each backing plate is urged forwardly by a coiled spring located behind the backing plate, the coiled spring being secured at the front of the track. The spring is coiled behind the backing plate such that when the forwardmost product within a track is removed, the backing plate pushes the row of products forwardly in the track by the force of the spring pushing on the rear of the backing plate. Again, this device utilizes a spring which is subject to wear over time. In addition, the backing plate rides within a groove in the shelf bottom and may become stuck in the groove causing the backing plate to not move forwardly.

Another patent which discloses a merchandise display device in which there is a pusher positioned at the rear of a display case or drawer for pushing product forwardly in the display case or drawer is U.S. Pat. No. 4,588,093. In this patent, the pusher is in the form of an accordion-like expansible member which includes plural steel spring biasing clips positioned at each of the apexes of the accordion.

Therefore, it has been one objective of the present invention to provide an inexpensive pushing mechanism for urging a column of products forwardly inside a track on a shelf which is not subject to wear over time and does not deteriorate with repeated use.

It further has been an objective of the present invention to provide a mechanism for urging columns of products forwardly in tracks on a shelf which does not need to be secured to a vertical wall behind the shelves.

Further, it has been an objective of the present invention to provide multiple pusher mechanisms for urging products forwardly on a shelf which are slidably engagable with slots formed in the bottom of a shelf.

SUMMARY OF THE INVENTION

The invention of this application which accomplishes these objectives comprises a shelf assembly comprising a shelf support and at least one shelf supported by the shelf support. The shelf support may comprise four vertical posts secured to a base, a vertical wall or any other supporting structure. Likewise, the shelf may take on multiple forms in accordance with the present invention. One form of shelf comprises a generally planar shelf bottom having a front edge and a rear edge. The shelf bottom may have a plurality of slots extending through the bottom of the shelf from back to front. The shelf may have a plurality of dividers extending upwardly from the shelf bottom, a pair of dividers and the shelf bottom defining a track for supporting a plurality of aligned products arranged in a column extending from the back of the shelf to the front of the shelf. The dividers may be an integral part of the shelf bottom or, alternatively, may be separately formed and secured in any number of ways to the shelf bottom. The lateral spacing between adjacent dividers may vary so that the tracks are of alternative widths. Alternatively, the tracks may be of the same width. Another form of shelf which may be used in accordance with the present invention does not have a solid generally planar shelf bottom but, rather, is made up of a plurality of parallel wires extending from the front of the shelf rearwardly to the back of the shelf. Such a shelf may have a generally vertical front portion and a generally vertical rear portion with a plurality of parallel wires extending between the front portion and the rear portion. The front portion acts as a bumper stop in order to prevent products from falling off the front of the shelf. Regardless of which type of shelf is used, the shelf may either be horizontally oriented or declined as is common in the art of merchandising products.

A plurality of pushers are supported by the shelf and engaged with the shelf for urging products supported by the shelf forwardly toward the front of the shelf. Each pusher comprises a sheet of flexible material having a memory characteristic or property which biases the sheet of material into a generally planar orientation from an inverted U-shaped configuration between a product and the rear of the shelf. The pushers are forced into an upwardly bowed inverted U-shaped configuration between the rear of the shelf and a rearwardmost product in a column of products in a track so as to urge the column of products forwardly toward the front of the shelf.

Each pusher may be independently formed and secured to the rear of the shelf by rivets, staples or any other type of fasteners. Alternatively, the pushers may be formed of a common sheet of plastic slit into a plurality of parallel fingers or pushers.

Such a sheet may be separately formed and secured to the rear portion of the shelf in any number of ways including riveting, stapling or clipping. The slits separating pushers from one another may extend from the front of the sheet of plastic all the way to the rear edge of the sheet or, alternatively, may stop short of the rear edge of the sheet so that all the pushers are integrally connected, each pusher extending forwardly from a common rear portion of the sheet.

Each pusher may have a pair of tabs extending downwardly from the pusher, the tabs being adapted to engage one of the slots formed in the bottom of the shelf. A first or forwardmost tab extends downwardly from the front edge of the pusher and a second tab integrally formed from the middle of the pusher also extends downwardly so as to create a forwardmost loop or inverted "V" in the pusher which abuts against the rearwardmost product within a column of products.

In order to more easily load a shelf with product, all of the pushers located on a shelf may be pulled back simultaneously to a loading position in which the pushers are in an upwardly bowed inverted U-shaped configuration. This may be accomplished with a lock bar which is located underneath the shelf and is adapted to engage the tabs of multiple pushers simultaneously to pull them all rearwardly as the lock bar is moved rearwardly in guides formed in side portions of the shelf.

An alternative method of forcing the pushers into an upwardly bowed inverted U-shaped configuration and holding the pushers in such a configuration for loading purposes utilizes a two part shelf. The two part shelf has a stationary portion and a slidable portion. In one embodiment, the pushers are secured to the slidable portion of the shelf. The slidable portion of the shelf is pulled forwardly. A stationary lock bar catches the pushers causing them to assume an upwardly bowed, inverted U-shaped configuration. Product is then loaded onto the slidable portion of the shelf. The slidable portion of the shelf is then pushed inwardly to its original position, the rearwardmost products pushing rearwardly on the front of the pushers forcing the pushers into an upwardly bowed inverted U-shaped configuration. In another embodiment, the pushers are secured to the stationary portion of the shelf. In both embodiments, such a sliding two part shelf enables product to force the pushers into an upwardly bowed inverted U-shaped configuration toward the rear of the shelf and hold the pushers in such a position. The sliding shelf also enables a person to more quickly and easily fill the shelf with product such as for example in a vending machine.

The pushers of the present invention may also have holes formed therein adapted to receive individual wires of a wire shelf. Such pushers may not be easily separated from the shelf and help in urging product toward the front of the wire shelf.

Utilizing these different methods of simultaneously pulling back all of the pushers on a shelf to more easily load product on the shelf increases the time and cost savings of loading shelves.

These and other objects and advantages of the invention of this application will become more readily apparent from the following description of the drawings.

BRIEF DESCRIPTION OF THE DRAWINGS

FIG. 3A is a side elevational view of a shelf assembly having no product therein with the pushers extended all the way forwardly;

FIG. 3B is a side elevational view of the shelf assembly of FIG. 3A with the pushers pulled all the way back by a lock bar and held in a loading position;

FIG. 3C is a side elevational view of the shelf assembly of FIG. 3A loaded with product and the lock bar in its original position;

FIG. 4A illustrates a shelf assembly having a shelf with a slidable portion and a stationary portion, the slidable shelf portion having no guides therethrough;

FIG. 4B is a side elevational view of the shelf assembly of FIG. 4A with the slidable portion of the shelf fully extended but having no product thereon;

FIG. 4C is a side elevational view of the shelf assembly of FIG. 4A with the slidable portion of the shelf being full of product and pushed rearwardly to a loaded position;

FIG. 5A illustrates a shelf assembly having a shelf with a slidable portion and a stationary portion, the pushers being secured to the slidable portion;

FIG. 5B illustrates the shelf assembly of FIG. 5A, the slidable portion of the shelf being pulled all the way outward to an extended position;

FIG. 5C illustrates a shelf assembly of FIG. 5A with the shelf assembly full of product.

DETAILED DESCRIPTION OF THE DRAWINGS

Figure 1:
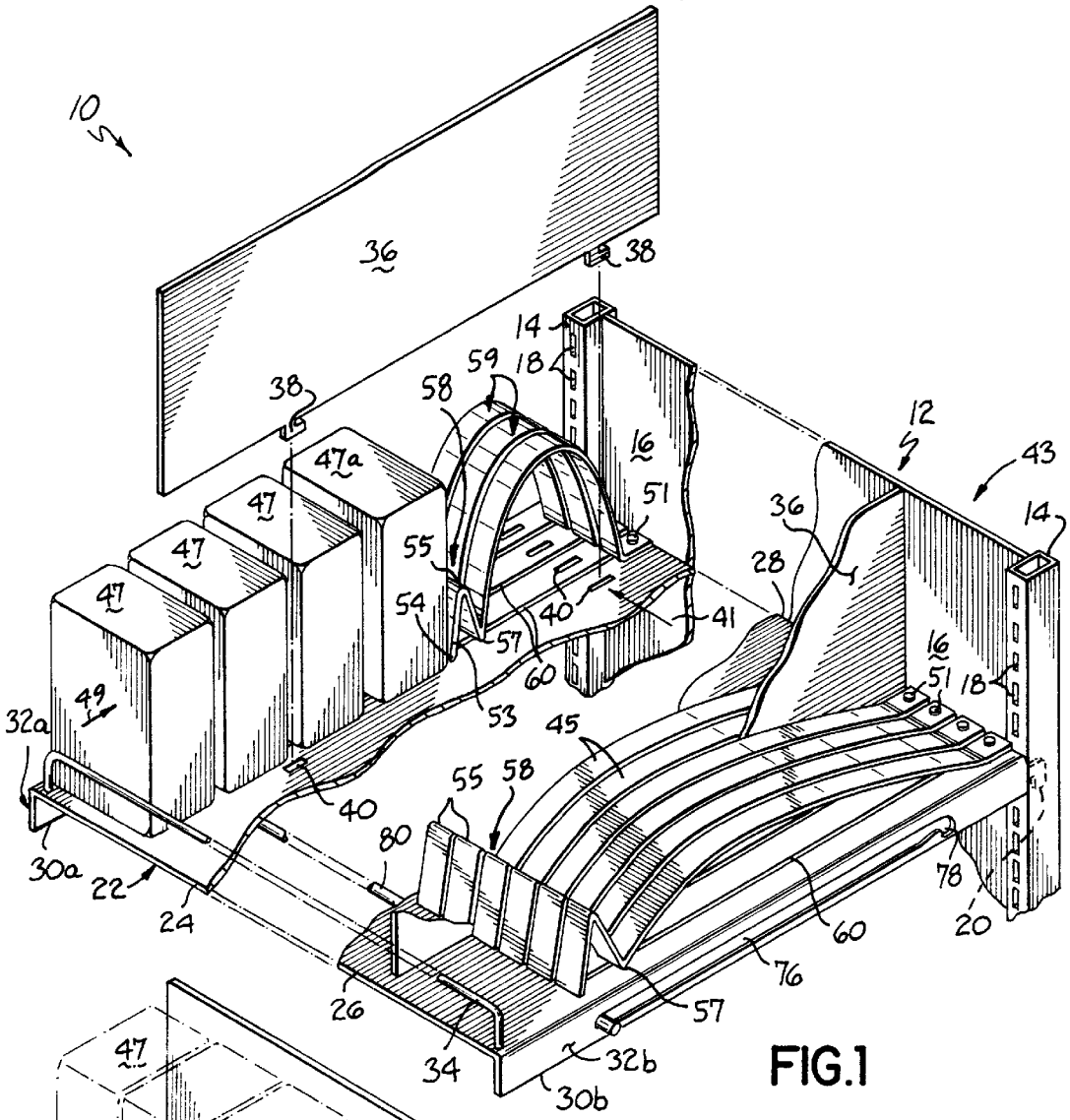
FIG. 1 is a perspective view of one embodiment of the shelf assembly of the present invention comprising a shelf support, shelf and a plurality of pushers.

Referring to the drawings and particularly to FIG. 1, there is illustrated a shelf assembly 10 including a shelf support 12.

The shelf support 12 may take any number of forms such as gondola racks or four poster racks. For purposes of illustration, the shelf support 12 is illustrated in FIG. 1 as being two vertical posts 14 having a back member 16 extending between them. Such a shelf support 12 is typically anchored by a base (not shown). As illustrated in FIG. 1, the posts 14 have a plurality of spaced key-shaped holes 18 therein adapted to receive projections 20 extending rearwardly from a shelf 22. Although one apparatus and method of securing a shelf to a shelf support is illustrated, others well known in the industry may be used as well.

The shelf 22 has a bottom 24 extending from a front edge 26 to a rear edge 28, the rear edge 28 abutting against the back member 16 of the shelf support 12. The bottom 24 of the shelf extends from one side edge 30*a* to an opposite side edge 30*b* and has two opposed downwardly extending vertical side portions 32*a*, 32*b*. The shelf 22 of the shelf assembly 10 may assume any number of forms and configurations. This application is not intended to limit the shelf to the configuration illustrated in FIG. 1.

The shelf assembly 10 further includes a bumper stop 34 located at the front of the shelf which functions to prevent products from falling off the front edge of the shelf. The bumper stop 34 is illustrated as extending across the substantial width of the shelf. However, multiple bumper stops may be located at the front of the shelf as well.

Additionally, the shelf assembly 10 may include a plurality of substantially planar dividers 36. The dividers 36 may be removably secured to the bottom of the shelf. The dividers 36 are illustrated as having a pair of downwardly extending hooks 38 adapted to be received within openings 40 formed in the shelf bottom 24. The bottom 24 of the shelf has at least one row 41 of aligned openings transversely spaced from one another. The spacing of the openings 41 permits the dividers 36 to be transversely moved to different locations so as to change the width, i.e., distance, between adjacent dividers. Thus, different products of different widths may be displayed on one shelf. Also as product displayed on the shelf changes, the dividers may be relocated.

Although one method (using hooks 38 and openings 41) of securing dividers to a shelf bottom is illustrated, multiple alternative methods and apparatus of securing the dividers to the shelf bottom may be utilized as well. The dividers 36 may be separately formed as illustrated in FIG. 1, or integrally formed with the bottom of the shelf. In either case, a pair of adjacent dividers and the bottom of the shelf form a track 43. A shelf 22 may have any number of tracks 43 depending on the number of dividers 36.

As seen in FIG. 1, a plurality of pushers 45 are engaged with the shelf. The pushers 45 push product 47 forwardly toward the front edge 26 of the shelf. The products 47 are arranged in linear columns 49 within the tracks 43 and are supported by the shelf bottom 24 and a pair of adjacent dividers 36. The products 47 may be packages of food, such as coffee or boxes of crackers or other non-food items such as tissues. The fact that the dividers 36 are laterally adjustable so as to change the width of the tracks enables different products to be placed on the same shelf. Therefore, the tracks may be of differing widths so that different products may be located in adjacent tracks 43. Each of the pushers 45 is illustrated in FIG. 1 as being a separate element riveted or otherwise secured by fasteners 51 at the rear thereof. Each pusher 45 is secured with a different fastener to the shelf bottom 24. The pushers 45 need not be fastened to the shelf bottom 24 but preferably are so fastened.

Figure 2:
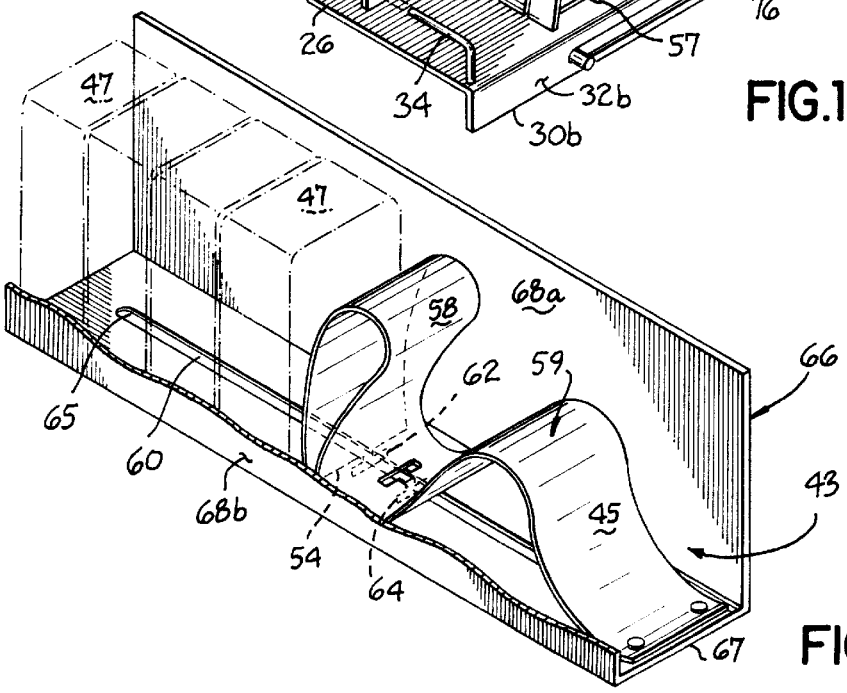
FIG. 2 is a perspective view of a product holder of the present invention with a pusher adapted to push product forwardly in the product holder.
Figure 1A:
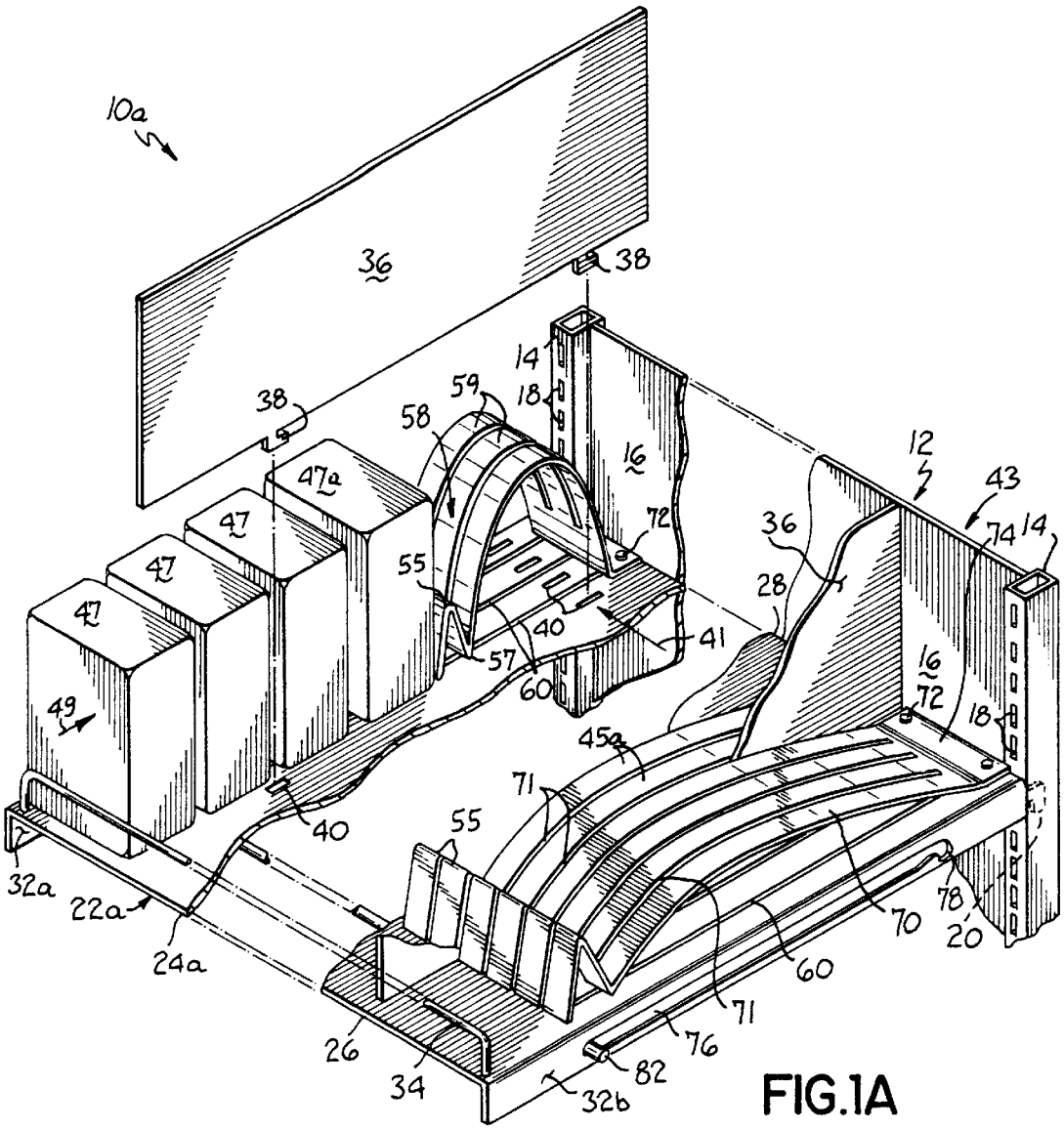
FIG. 1A is a perspective view like FIG. 1 illustrating an alternative embodiment of shelf assembly comprising a shelf support, a shelf and a sheet of plastic divided into a plurality of pushers for urging product forwardly on the shelf.

Each pusher 45 is made of a flexible material having a memory characteristic which biases the pusher toward a generally flat planar orientation from an inverted U-shaped configuration between a rearmost product 47*a* in a column 49 of products and the rear edge 28 of the shelf. Each pusher 45 has a substantially planar front portion 53 extending upwardly from a front edge 54 to an apex 55. The apex 55 may be pointed as illustrated in FIGS. 1 and 1A or may be generally U-shaped as illustrated in FIG. 2. From apex 55, the pusher 45 extends downwardly to a bottom point 57 to form a generally inverted V-shaped portion 58. The pusher 45 then extends rearwardly and upwardly from bottom point 57 to form an inverted U-shaped or bowed portion 59. The pushers 45 are located next to each other so that at least one pusher is located between adjacent dividers in a track. Multiple pushers within a track increases the force exerted on the rear of the rearwardmost product 47*a* located in the track and pushes it toward the front edge of the shelf. The bottom of the shelf has a plurality of substantially parallel slots 60 therein extending from front to back. Each pusher 45 has at least one tab adapted to slidably engage one of the slots 60.

The pusher 45 may be made of numerous sheet materials such as sheet plastic or other sheet material. One type of plastic sheet material which has been used successfully is made from an amorphous glycol modified polyethylene terephthalate (PETG), commercially available from Eastman Chemical Company. PETG is a polyester prepared by the reaction of cyclohexanedimethanol and ethylene glycol with terephthalic acid. Polyethylene terephthalate film is generally characterized by a relatively high resistance to failure on repeated flexing, and has high tensile strength and low moisture absorption. Products made of polyethylene terephthalate have high impact strength, the requisite plastic memory and are able to withstand multiple flexions. By plastic memory what is meant is simply the tendency of the material to return to a given shape upon the release of an externally applied force. Though PETG has been successfully used to make a pusher 45, this application does not intend to limit the composition of the pusher to one specific material such as PETG. The pusher 45 may be made of any number of different materials including plastics having acceptable flexion and memory properties, including but not limited to polyesters of which polyethylene terephthalate is one.

Referring now to FIG. 2, each pusher 45 has a first tab 62 extending downwardly from the front edge 54 of the pusher.

Additionally, the pusher has a second tab 64 which may be cut out of a portion of the pusher material as illustrated in FIG. 2 or a separate element. Each of the tabs 62, 64 is essentially in the shape of a T although tabs of differing shapes may be used as well. The tabs are shaped to ride inside the slots 60 and prevent the pusher 45 from separating from the shelf bottom. As illustrated in FIG. 1, each of the slots 60 does not extend all the way to the front edge of the shelf bottom but does have a forwardmost end 65 spaced slightly rearwardly from the front edge of the shelf.

FIG. 2 illustrates a generally U-shaped product holder 66, adapted to be placed on a shelf bottom. The product holder comprises a bottom 67 and a pair of sidewall dividers 68*a*, 68*b* which extend upwardly from the bottom 67 forming a generally U-shaped or channel-shaped product holder. The two sidewall dividers 68*a*, 68*b* and the bottom 67 of the product holder 66 form a track 43 extending from front to back of the product holder adapted to receive a column of products 47. The bottoms 67 of the U-shaped product holders 66 each have a slot 60 therethrough adapted to receive the tabs of a pusher as illustrated in FIG. 2. The U-shaped product holders 66 may be placed on any type of shelf.

FIG. 1A illustrates an alternative embodiment of the shelf assembly of the present invention 10*a*. For simplicity, like parts will be given like reference numerals. Different embodiments will be designated with different letter suffixes. In this embodiment, the same shelf 22 is utilized as was utilized in the shelf assembly 10 of FIG. 1. However, rather than utilizing a plurality of parallel separate pushers 45, this embodiment utilizes a sheet of plastic 70 having a plurality of slits or cuts 71 extending front to back defining a plurality of pushers or fingers 45*a*. These pushers 45*a* are similar to those illustrated in FIG. 1 except that these pushers 45*a* are all an integral part of one common sheet 70 rather than individual units. The sheet 70 is secured with rivets or other fasteners 72 at the rear thereof to the shelf bottom 24*a*. The sheet 70 is of a flexible material having a memory characteristic which biases the sheet to a generally flat planar orientation and may be made from any of the materials described hereinabove. The sheet 70 has a common rear portion 74 which is not slit (see FIG. 1A).

Figure 3A:
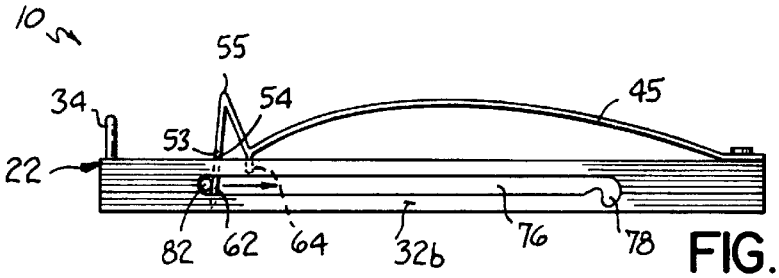
FIGS. 3A–3C illustrate an apparatus and method for loading the shelf assembly of the present invention with product.
Figure 3B:
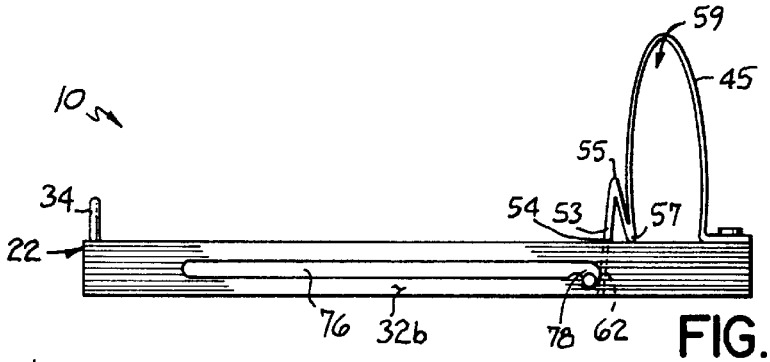
Figure 3C:
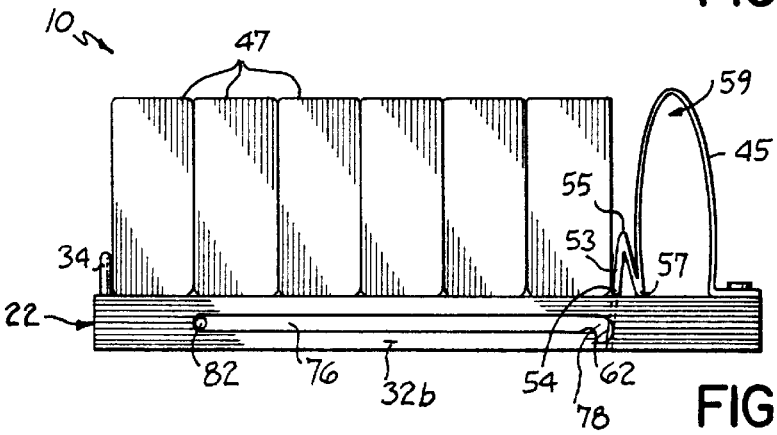

FIGS. 3A–3C illustrate one apparatus and method for loading a shelf with product. Referring now to FIG. 1, each of the side portions 32 of the shelf 22 has a guide 76 extending through the side portion. The guide 76 has a downwardly turned rear portion 78 which may be an arcuate. A lock bar 80 (see FIG. 1) extends through the guides 76 in the side portions 32 and extends across the entire width of the shelf. As illustrated in FIG. 3A, the lock bar 80 is located underneath the shelf bottom 24 and in front of the first tabs 62 of the pushers 45. Two end portions 82 of the lock bar 80 enable a user to grasp the lock bar and pull the lock bar rearwardly to a locked position in which the lock bar 80 rests in the rear portion 78 of the guides 76 as seen in FIG. 3B. As the lock bar 80 is being pulled rearwardly, the lock bar 80 pulls the first tabs 62 of the pushers 45 rearwardly until the lock bar 80 rests in the rear portions 78 of the guides 76. In such a position, the pushers are in a loading position. In this loading position illustrated in FIG. 3B, the pushers 45 assume an upwardly bowed inverted U-shaped configuration. All of the pushers 45 may be simultaneously moved rearwardly to a loading position and locked in such a loading position so that the shelf is free of pushers and may be loaded with product. With all of the pushers 45 locked in a retracted position, the shelf 22 is free to be loaded with columns of products. As seen in FIG. 3C, once the shelf is loaded with product the lock bar 80 may be released from the rear portions 78 of the guides 76 and moved forwardly to its starting or at rest position.

Figure 4A:
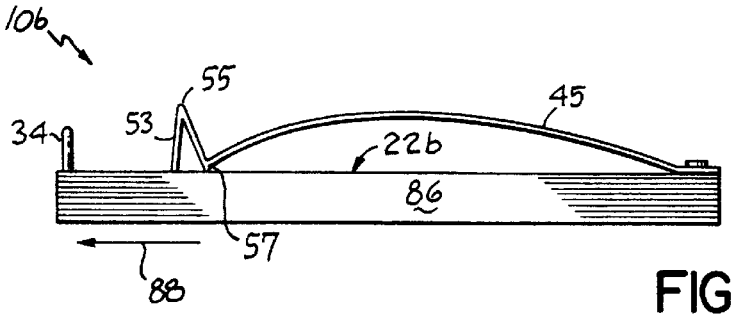
FIGS. 4A–4C illustrate an alternative apparatus and method for loading a shelf assembly with product.
Figure 4B:
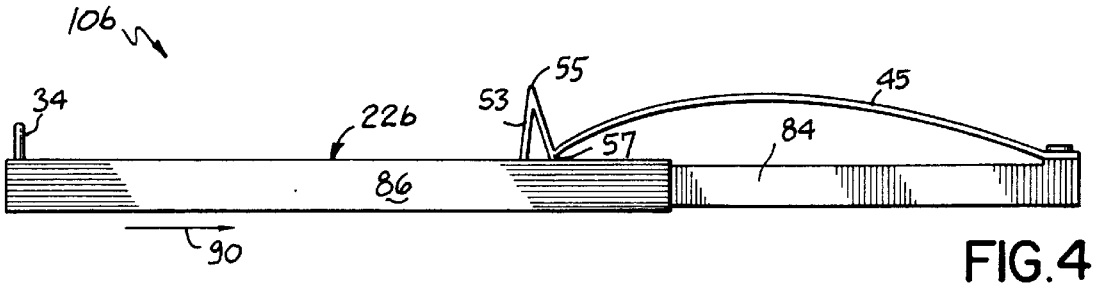
Figure 4C:
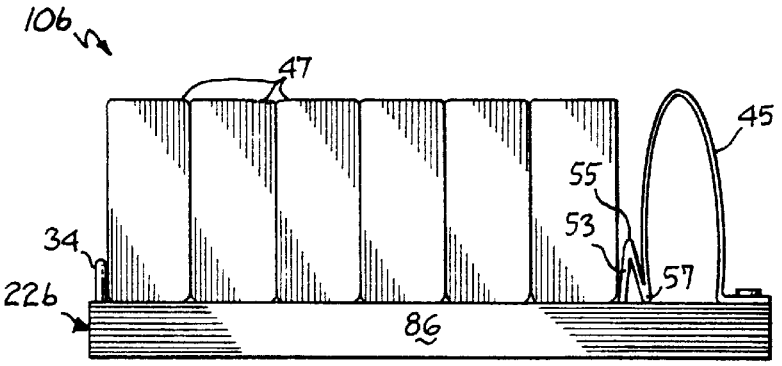

Referring to FIGS. 4A–4C, an alternative apparatus and method are illustrated for loading a shelf with product. These figures illustrate an alternative shelf assembly 10*b* very similar but not identical to the other embodiments of shelf assembly 10, 10*a*. The self assembly 10*b* comprises a two-part shelf 22*b* and a plurality of pushers 45. The shelf 22*b* comprises a stationary shelf portion 84 and a slidable shelf portion 86. The pushers 45 are secured at the rear thereof to the stationary shelf portion 84 as illustrated in FIG. 4B. As illustrated in FIG. 4A, to load a shelf with product once the shelf is empty of product and the pushers are fully extended is to pull the slidable shelf portion 86 toward the user in the direction of arrow 88 (to the left in FIG. 4A). This pulling motion moves the stationary shelf portion 84 away from the slidable shelf portion 86. Once the slidable shelf portion 86 is fully extended outwardly toward the user (to the left in FIG. 4B), the slidable shelf portion 86 is loaded with product and pushed back inwardly in the direction of arrow 90 toward the stationary shelf portion 84. While product is being loaded onto the slidable shelf portion 86 the pushers 45 remain extended and are not affected by the loading of the shelf. This facilitates an easy and quick loading or stocking of the shelf. As the slidable shelf portion 86 is moved in the direction of arrow 90, the rearwardmost products within each column of products abut against and push rearwardly the pushers 45 within each track causing the pushers to assume a generally inverted U-shaped configuration until the slidable shelf portion 86 is aligned with and over the stationary shelf portion 84 as seen in FIG. 4C.

Figure 5A:
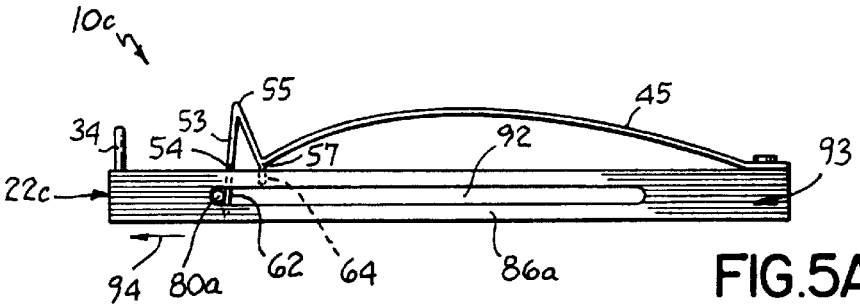
FIGS. 5A–5C illustrate another apparatus and method for loading a shelf assembly with product.
Figure 5B:
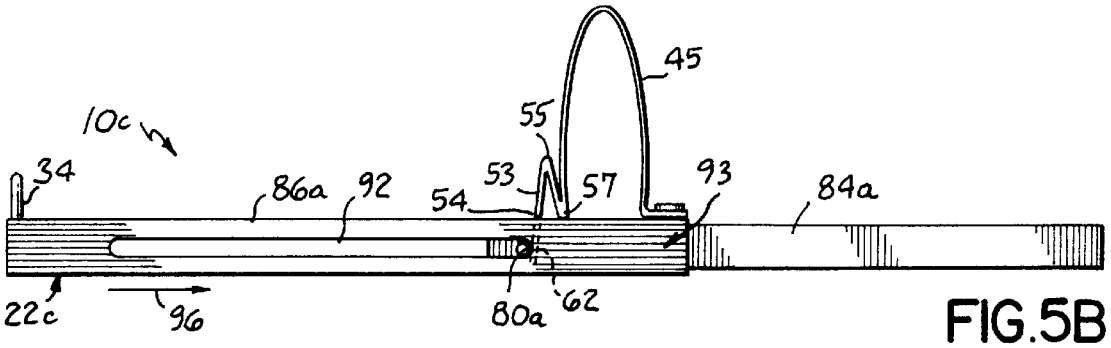
Figure 5C:
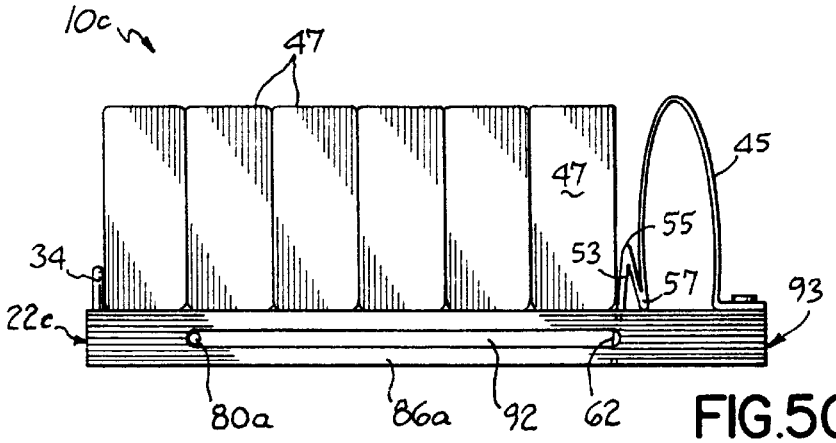

FIGS. 5A–5C illustrate an alternative shelf assembly 10*c* and method of loading the shelf assembly with product. Like the shelf assembly 10*b* illustrated in FIGS. 4A–4C, this shelf assembly 10*c* comprises a two part shelf having a stationary shelf portion 84*a* and a slidable shelf portion 86*a*. Elongate guides 92 are formed through the side portions 93 of the slidable shelf portion 86*a*. However, a lock bar 80*a* extends across the width of the stationary shelf portion 84*a* and is adapted to slide inside of the elongate guides 92 formed in the slidable shelf portion 86*a*. The pushers 45 are secured to the rear of the slidable shelf portion 86*a* rather than to the stationary shelf portion 84*a* in this embodiment.

As illustrated in FIG. 5A, once the shelf becomes empty or low of product, the user pulls the slidable shelf portion 86*a* in the direction of arrow 94 away from the stationary shelf portion 84*a*. The lock bar 80*a* remains stationary, secured to the stationary shelf portion 84*a*. The pushers 45 secured to the slidable shelf portion 86*a* move with the slidable shelf portion 86*a*. The tabs of the pushers abut against the lock bar 80*a* causing the pushers to compress and assume a more inverted U-shape configuration than that illustrated in FIG. 5A. In FIG. 5B, the two shelf portions 86*a*, 84*a* are located away from each other so that the product (not shown) may be loaded onto the top surface of slidable shelf portion 86*a*. The pushers are in a compressed position out of the way of the user loading the shelf with product thus making loading easier and more hassle free. Once the slidable shelf portion is loaded with product, the slidable shelf portion 86*a* is pushed in the direction of arrow 96 to the position illustrated in FIG. 5C with the shelf full of product.

Figure 6:
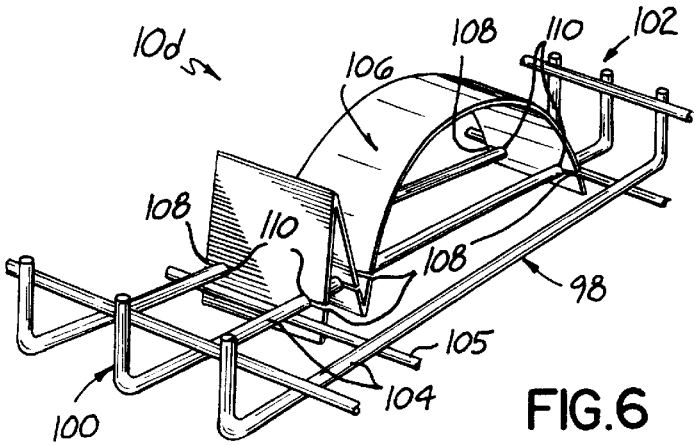
FIG. 6 is a perspective view of an alternative embodiment of shelf assembly of the present invention, the shelf comprising a plurality of spaced wires.

An alternative embodiment of shelf assembly 10*d* is illustrated in FIG. 6. This embodiment utilizes a shelf 98 which has a substantially vertical front portion 100 and a substantially vertical rear portion 102 and a plurality of parallel wires 104 extending from the front portion 100 to the rear portion 102. The front and rear portions of the shelf are formed from the ends of the wires 104. A transversely extending wire 105 functions as a forward stop. This embodiment utilizes a plurality of pushers 106, only one being shown in FIG. 6, which are similar in shape and identical in material to the pushers otherwise disclosed in this application. Thus the pusher is made of a flexible material having a memory characteristic which biases the pusher to a generally planar orientation. Each pusher 106 is capable of assuming an upwardly bowed inverted U-shaped configuration between the rear portion of the shelf 106 or some other bracing structure and a product resting on the shelf (not shown in FIG. 6) so as to urge product forwardly. Instead of having tabs extending downwardly from the pusher adapted to engage slots formed in the bottom of the shelf, this embodiment of pusher 106 has a plurality of slits 108 extending horizontally so as to engage the pusher 106 with the wires 104 of the shelf. Each slit 108 extends inwardly from a peripheral side edge of the pusher to a circular hole 110 which slides on one of the wires 104. When one desires to remove the pusher from the shelf assembly for cleaning purposes or for any other reason, one simply pulls the wires 104 through the slits 108 in the pusher so as to disengage the pusher 106 from the wires 104. To reinsert the pusher 106, one simply pushes the shelf wires 104 through the slits 108 until the wires 104 reside in the circular holes 110. The pusher 106 will extend forwardly until the front of the pusher 106 abuts against the transversely extending wire 105. In all other respects, the pusher 106 functions identically to the pushers described hereinabove.

Although I have described multiple preferred embodiments of the present invention, it will be readily apparent by those of ordinary skill in the art that many modifications may be made without departing from the spirit and scope of the present invention. It is therefore applicant's intention to be bound only by the scope of the claims and not to be bound by the detailed specifics provided in the specification above.

I claim:

1. A shelf assembly for merchandising a plurality of products arranged in columns, said shelf assembly comprising:

a shelf having a bottom, a front edge, a rear edge and a pair of opposed side edges, a plurality of parallel pushers engaged with said shelf for urging one of said columns of products supported by said shelf toward said front edge of said shelf, each of said pushers having a memory characteristic and being adapted to assume an inverted U-shaped configuration above said shelf bottom between said one of said columns of products and said rear edge of said shelf upon receipt of said one of said columns of products such that said memory characteristic urges said pushers towards a generally planar orientation so as to urge said one of said columns of products forwardly.

2. The shelf assembly of claim 1 further comprising a plurality of dividers removably secured to said bottom of said shelf, an adjacent pair of said dividers and said bottom of said shelf defining a track, whereby the number of said pushers within said track may be varied by laterally adjusting the adjacent pair of said dividers.

3. The shelf assembly of claim 2 wherein said pushers extend from one of said side edges of said shelf to the other of said side edges of said shelf.

4. The shelf assembly of claim 1 further comprising means for holding said pushers in said inverted U-shaped configuration.

5. The shelf assembly of claim 1 wherein said shelf has a plurality of slots and each-of said pushers has at least one tab which slidably engages one of said slots.

6. The shelf assembly of claim 1 wherein said shelf bottom comprises a plurality of parallel wires.

7. The shelf assembly of claim 6 wherein said pushers have holes therein which to receive said wires of said shelf.

8. The shelf assembly of claim 7, wherein each of said pushers has at least one slot extending inwardly from a side edge thereof and terminating at one of said holes.

9. A shelf assembly comprising:

a shelf for supporting a plurality of products arranged in columns, said shelf having a front edge and a rear edge, a single sheet of material having a memory characteristic, said sheet being engaged with said shelf and being divided by at least one slit into a plurality of pushers said pushers being adapted to assume an inverted U-shaped configuration above said shelf between said rear edge of said shelf and one of said columns of products upon receipt of said one of said columns of products such that said memory characteristic causes said pushers to return to a generally planar orientation so as to urge said one of said columns of products forwardly toward said front edge of said shelf.

10. The shelf assembly of claim 9 further comprising a plurality of adjustable dividers extending upwardly from said shelf whereby the number of said pushers between an adjacent pair of said dividers may be varied by laterally adjusting the adjacent pair of said dividers.

11. The shelf assembly of claim 9 wherein said single sheet of material is secured to said shelf.

12. The shelf assembly of claim 9 wherein said shelf has a plurality of slots and each of said pushers has at least one tab slidably engaged with one of said slots.

13. The shelf assembly of claim 12 further comprising means adapted to engage said pushers for holding said pushers in said inverted U-shaped configuration.

14. A shelf assembly comprising:

a shelf having a front edge and a plurality of slots, a sheet engaged with said shelf, said sheet being divided into a plurality of pushers for urging products forwardly toward said front edge of said shelf, said pushers being of a material having a memory characteristic which causes said pushers to assume a generally planar orientation, each of said pushers having at least one tab slidably engaged with one of said slots, a lock bar located underneath said shelf adapted to engage the tabs of said pushers in order to hold said pushers in an upwardly bowed inverted U-shaped configuration.

15. A shelf assembly for merchandising a plurality of products arranged in columns, said shelf assembly comprising:

a shelf having a shelf bottom, a sheet divided into a plurality of parallel pushers by slits in said sheet, said sheet having a rear portion engaged with said shelf, said pushers being of a plastic material having a memory characteristic which causes said pushers to assume a generally planar orientation, each pusher being capable of moving from said generally planar orientation to an upwardly bowed, inverted U-shaped configuration above said shelf bottom between said rear portion of said sheet and a rearwardmost one of said products in one of said columns of products upon receipt of said one of said columns of products such that said memory characteristic urges said one of said columns of products forwardly.

16. The shelf assembly of claim 12 wherein said shelf has a plurality of slots and each of said pushers has at least one tab slidably engaged with one of said slots.

17. The shelf assembly of claim 15 further comprising a plurality of dividers removably secured to said shelf bottom.

18. The shelf assembly of claim 15 wherein said rear portion of said sheet is secured to said shelf.

19. A shelf assembly comprising:

a shelf having a shelf bottom and a plurality of slots, a sheet divided into a plurality of pushers for urging products arranged in columns forwardly, said sheet having a rear portion engaged with said shelf, said pushers and being of a plastic material having a memory characteristic which causes said pushers to assume a generally planar orientation, each of said pushers being capable of assuming an upwardly bowed, inverted U-shaped configuration between said rear portion of said sheet and a rearwardmost one of said products in said column of products so as to urge said column of products forwardly, each of said pushers having at least one tab slidably engaged with one of said slots, a lock bar located underneath said shelf bottom adapted to engage the tabs of said pushers in order to hold said pushers in said upwardly bowed inverted U-shaped configuration.

20. A shelf assembly for merchandising a plurality of products arranged in columns, said shelf assembly comprising:

a shelf having a shelf bottom, said shelf bottom having a plurality of parallel slots, a sheet having a rear portion engaged with said shelf, said sheet being divided into a plurality of pushers by slits cut in said sheet, said pushers being of a plastic material having a memory characteristic which causes said pushers to assume a generally planar orientation, each pusher having a pair of tabs slidably engaged with one of said slots and being capable of assuming an upwardly bowed, inverted U-shaped configuration above said shelf bottom between said rear portion of said sheet and one of the columns of products upon receipt of the one of the columns of products such that said memory characteristic urges the one of the columns of products toward a front edge of said shelf.

21. The shelf assembly of claim 20 further comprising a plurality of dividers extending upwardly from said shelf bottom, wherein a plurality of said pushers are located between an adjacent pain of said dividers.

22. The shelf assembly of claim 20 wherein said pushers may be pushed backwardly into said upwardly bowed, inverted U-shaped configuration by a lock bar, said lock bar preventing said pushers from extending forwardly while said pushers are in said upwardly bowed, inverted U-shaped configuration.

23. The shelf assembly of claim 20 wherein each pusher has a planar front portion located at a front end of the pusher.

24. A shelf assembly comprising:

a shelf support, a shelf having a shelf bottom, a rear edge, a front edge and a plurality of substantially parallel dividers extending between said rear and front edges, said shelf bottom supporting a plurality of products arranged in columns between adjacent pairs of said dividers, said pairs of adjacent dividers and said shelf bottom defining a plurality of tracks, a width of each track being defined by a distance between said adjacent dividers, at least two plastic pushers within each track for urging one of said columns of products forwardly in said track, said plastic pushers having a memory characteristic and being adapted to assume an inverted U-shaped configuration above said shelf bottom upon receipt of said columns of products such that said memory characteristic causes said pushers to return to a planar orientation so as to urge said columns of products forwardly wherein the number of pushers within each track is adjusted by adjusting the width of the track.

25. The shelf assembly of claim 24 wherein said pushers are secured to said shelf.

26. The shelf assembly of claim 24 wherein said shelf bottom has a plurality of slots therein and each of said pushers has at least one tab slidably engaged with one of said slots.

27. A method of urging a column of products forwardly in a track defined by two adjacent dividers and a shelf bottom, said shelf bottom having a slot therein, said method comprising: forcing a pusher having a tab slidably engaged with said slot into an upwardly bowed inverted U-shaped configuration above self shelf bottom between a rearwardmost product in said column and a rear stop such that a memory characteristic of said pusher causes said pusher to push said rearward most product in said column of products forwardly in said track.

28. A method of urging columns of products forwardly on a shelf, said shelf having a shelf bottom with a plurality of slots therein and a plurality of dividers extending upwardly from said shelf bottom, said method comprising the steps of:

securing a plastic sheet to said shelf bottom, said plastic sheet being divided into a plurality of pushers, each of said pushers having at least one tab slidably engaged with one of said slots, forcing each of said pushers into an upwardly bowed inverted U-shaped configuration above said shelf bottom and locking said pushers in said configuration, loading said columns of products on said shelf between said dividers and in front of said pushers, releasing said pushers from said configuration such that a memory characteristic of each pusher causes each pusher to urge a respective one of said columns of products forwardly.

29. The method of claim 28 wherein said forcing step comprises pushing a locking bar rearwardly, said locking bar engaging said tabs of said pushers.

30. The method of claim 28 wherein said forcing step comprises pulling said shelf forwardly.

31. A method of merchandising product on a shelf, said shelf having a front portion, a rear portion and a plurality of parallel wires extending between said front and rear portions, said method comprising the steps of:

engaging a plurality of plastic pushers with said rear portion of said shelf, forcing said pushers into an upwardly bowed inverted U-shaped configuration above said shelf and holding said pushers in said configuration, loading said product on said shelf in front of said pushers, releasing said pushers from said configuration such that a memory characteristic of each pusher causes each pusher to engage said product and urge said product forwardly.

32. A combination of a pusher and a track, said track adapted to support a plurality of products arranged in a column, said track comprising a bottom and a pair of dividers extending upwardly from said bottom, said bottom having a slot therethrough, said pusher comprising a sheet of material having a memory characteristic which urges said pusher toward a generally flat planar orientation from an inverted generally U-shaped orientation, said pusher having at least one tab slidably engaged with said slot, said pusher is adapted to assume said inverted generally U-shaped orientation above said bottom of said track upon receipt of said column of products such that said memory characteristic causes said pusher to expand inside said track upon removal of at least one of said products from said track without said pusher separating from said bottom of said track to urge said column of products forwardly.

33. A shelf assembly for merchandising a plurality of products arranged in columns, said shelf assembly comprising:

a shelf having a front edge, a rear edge and a pair of opposed side edges, a plurality of parallel pushers engaged with said shelf for urging said columns of products toward said front edge of said shelf, each of said pushers having a memory characteristic and being adapted to assume an inverted U-shaped configuration above said shelf between one of said columns of products and said rear edge of said shelf upon receipt of said one of said columns of products such that said memory characteristic urges said pusher towards a generally planar orientation so as to urge said one of said columns of products forwardly.

* * * * *

UNITED STATES PATENT AND TRADEMARK OFFICE

CERTIFICATE OF CORRECTION

PATENT NO. : 6,082,558
DATED : July 4, 2000
INVENTOR(S) : Joseph M. Battaglia

It is certified that error appears in the above-identified patent and that said Letters Patent is hereby corrected as shown below:

Column 8, line 2, "self" should be --shelf--.

Column 9, line 63, "each-of" should be --each of--.

Column 9, line 68, "which to receive" should be --which receive--.

Column 10, line 60, "claim 12" should be --claim 15--.

Column 11, line 6, "pushers and being" should be --pushers being--.

Column 11, line 41, "pain" should be --pair--.

Column 12, line 15, "self" should be --shelf--.

Column 12, line 18, "rearward most" should be --rearwardmost--.

Signed and Sealed this

Fifth Day of June, 2001

Nicholas P. Godici

NICHOLAS P. GODICI

*Acting Director of the United States Patent and Trademark Office*

*Attest:*

*Attesting Officer*